US005579072A

United States Patent [19]

Frank et al.

[11] Patent Number: 5,579,072

[45] Date of Patent: Nov. 26, 1996

[54] FILM DRYING APPARATUS WITH UNIFORM FLOW AIR TUBES

[75] Inventors: Lee F. Frank, Rochester; David K. Bischoff, Fairport, both of N.Y.

[73] Assignee: Eastman Kodak Company, Rochester, N.Y.

[21] Appl. No.: 538,103

[22] Filed: Oct. 2, 1995

Related U.S. Application Data

[62] Division of Ser. No. 389,528, Feb. 16, 1995, Pat. No. 5,481,327.

[51] Int. Cl.[6] ..... G03D 7/00; G03D 3/02

[52] U.S. Cl. ..... 396/579; 34/640

[58] Field of Search ..... 354/300, 319–324; 34/219, 640, 641, 652, 653, 655, 656, 654

[56] References Cited

U.S. PATENT DOCUMENTS

| | | | |
|---|---|---|---|
| 3,074,179 | 1/1963 | Stelling, Jr. | 34/654 |
| 4,060,914 | 12/1977 | Hoffman | 34/219 |
| 4,167,319 | 9/1979 | Feitzinger et al. | 354/300 |
| 4,377,331 | 3/1983 | Seelenbinder et al. | 354/300 |
| 4,431,294 | 2/1984 | Baker | 354/322 |
| 4,693,014 | 9/1987 | Caflisch et al. | 34/23 |
| 4,779,357 | 10/1988 | Troetscher | 34/638 |
| 5,222,309 | 6/1993 | Ross | 34/638 |
| 5,231,744 | 8/1993 | Kose et al. | 34/160 |
| 5,398,094 | 3/1995 | Rosenburgh et al. | 354/324 |
| 5,416,551 | 5/1995 | Ishikawa et al. | 354/324 |

*Primary Examiner*—D. Rutledge
*Attorney, Agent, or Firm*—Peyton C. Watkins

[57] ABSTRACT

An air tube for use in a drying apparatus includes a tapered main tube body comprising an open air inlet end and a closed end opposite the open air inlet end, an air discharge port including an air exhaust slot, and an air diffuser located between the main tube body and the air discharge port, wherein the air diffuser includes a plurality of air flow apertures that are located at a position offset from the air exhaust slot of the air discharge port. The air tube is readily incorporated into a film processing system that includes a plurality of processing tanks, a film drying apparatus including a plurality of the air tubes, and a mechanism for transporting a photosensitive film through the processing tanks and into the film drying apparatus.

15 Claims, 6 Drawing Sheets

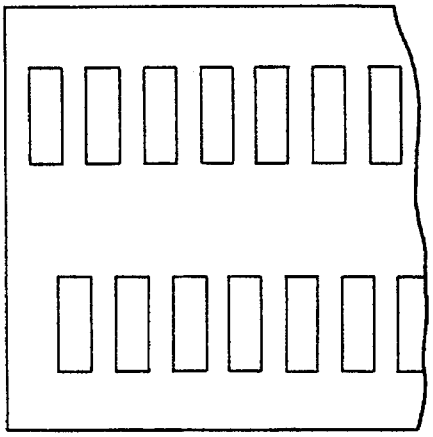
FIG. 4
FIG. 5
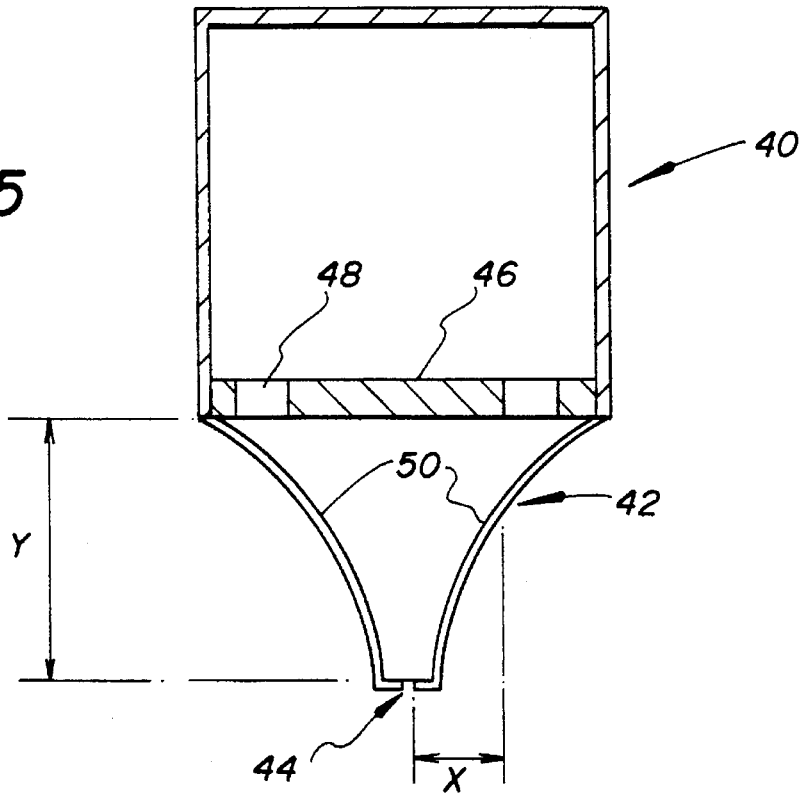

FILM DRYING APPARATUS WITH UNIFORM FLOW AIR TUBES

This is a divisional of application Ser. No. 08/389,528, filed Feb. 16, 1995 now U.S. Pat. No. 5,481,327.

FIELD OF THE INVENTION

The invention relates in general to a film drying apparatus for drying photosensitive films after completion of a film developing process. In particular, the invention relates to a film drying apparatus that incorporates a plurality of end-fed air tubes that produce a uniform output air flow.

BACKGROUND

Film drying apparatus have been employed to dry photosensitive film after completion of a wet developing process in conventional photographic developing systems. The photosensitive film is transported through the film drying apparatus by a transport mechanism that includes a plurality of rollers. The rollers guide the photosensitive film past a plurality of air tubes or chambers, each of which includes a longitudinal air discharge port. The air tube is generally made gradually smaller from an inlet end, through which drying air is supplied to an opposite closed end or exhaust end in an attempt to make the air flow uniform across the length of the discharge port.

It is particularly desirable to provide a uniform flow of drying air in both magnitude and direction to insure that the photosensitive film is properly dried. Inconsistent or uneven air flow can cause portions of the photosensitive film to be overexposed or underexposed to the drying air, which can lead to problems such as variations in film gloss (defined as the measure of specularity or directionality of the surface reflection), either as excessive gloss or patterns such as stripes or spots of differing gloss. Accordingly, a vector field representing the desired uniform flow of air from the discharge port would ideally consist of a plurality of parallel vectors perpendicular to the discharge port that are of uniform length.

It has been found, however, that conventional air tubes allow a non-uniformity in flow direction and magnitude along the length of the air tube as air progresses from the tube inlet and is forced to make a right angle turn to exit the discharge port. The air supplied to the air tube is under pressure and wants to take the path of least resistance. The air will therefore want to exit the discharge port at an angle. In addition, the highest velocity pressure will also be at the far end of the air tube away from the tube inlet, which produces non-uniformities that produce irregular drying patterns on the photosensitive film.

In view of the above, it is an object of the invention to provide an air tube for use in a film drying apparatus that produces a uniform output air flow, in both magnitude and direction, in order to maximize drying efficiency.

SUMMARY OF THE INVENTION

An air tube for use in a drying apparatus includes a tapered main tube body comprising an open air inlet end and a closed end opposite the open air inlet end, an air discharge port including an air exhaust slot, and an air diffuser located between the main tube body and the air discharge port, wherein the air diffuser includes a plurality of air flow apertures that are located at a position offset from the air exhaust slot of the air discharge port. The air tube is readily incorporated into a film processing system that includes a plurality of processing tanks, a film drying apparatus including a plurality of the air tubes, and a mechanism for transporting a photosensitive film through the processing tanks and into the film drying apparatus. Air exits the air tube in a direction normal to a plane defined by the air exhaust slot along the entire length of the slot and is uniform in magnitude.

BRIEF DESCRIPTION OF THE DRAWINGS

The invention will be described in greater detail with reference to certain preferred embodiments thereof and the accompanying drawings, wherein:

FIG. 4 illustrates the air flow apertures in the single air tube shown in FIG. 3;

FIG. 5 is a cross-sectional view of the air tube illustrated in FIG. 3;

DETAILED DESCRIPTION OF THE PREFERRED EMBODIMENT

Figure 1:
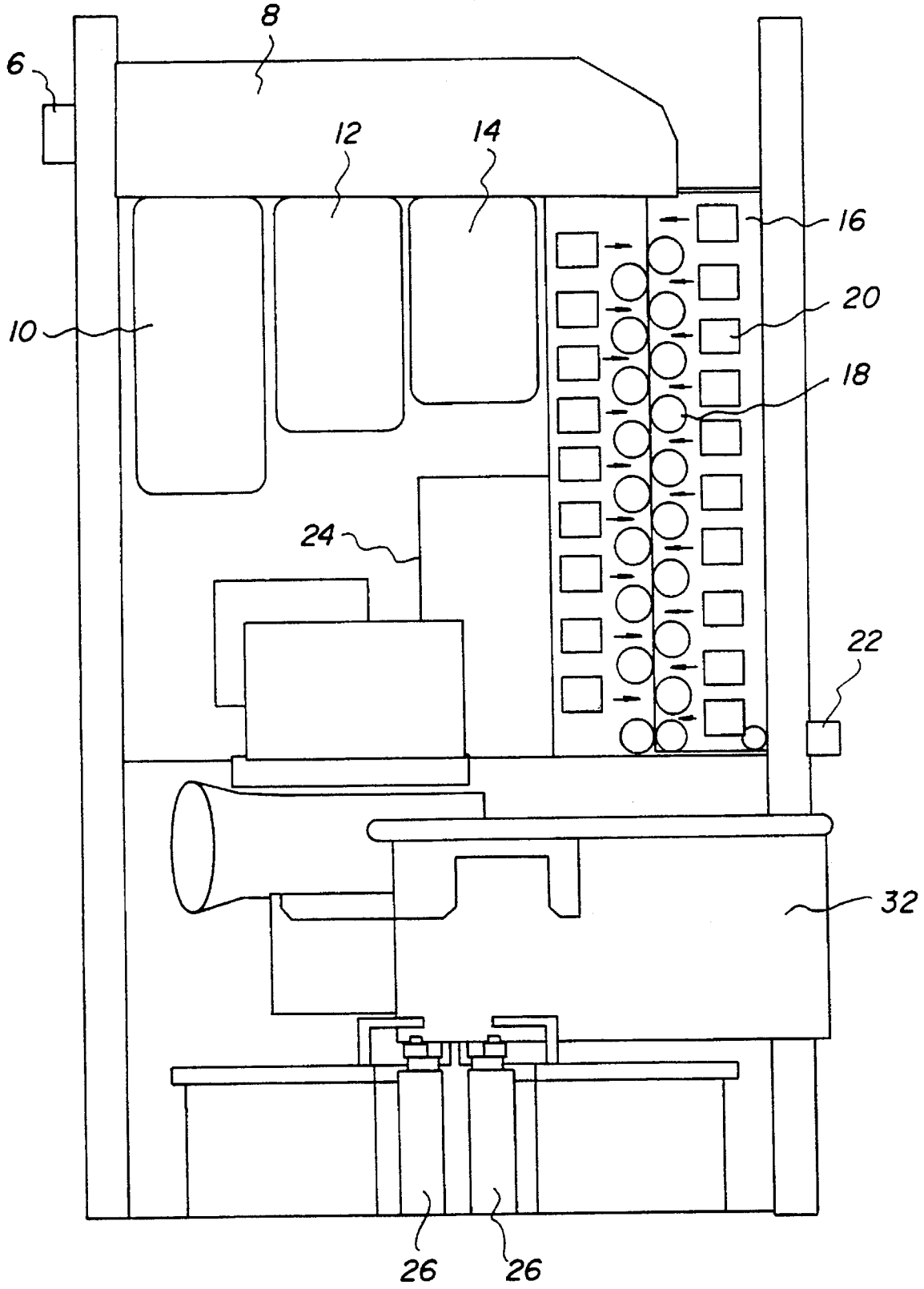
FIG. 1 is a side view of a film processing system including a film drying apparatus in accordance with the invention.

A film processing system is illustrated in FIG. 1 as including a film transport mechanism 8 located over a developer tank 10, a fixer tank 12 and a wash tank 14. The film transport mechanism 8 is of conventional design, and includes a plurality of rollers that are used to guide a photosensitive film inserted into a film input port 6 into the developer tank 10, from the developer tank 10 to the fixer tank 12, and from the fixer tank 12 to the wash tank 14 during a film developing process. After passing through the wash tank 14, the transport mechanism 8 guides the photosensitive film into a film drying apparatus 16 which includes a plurality of guide rollers 18 and end-fed air tubes 20. The guide rollers 18 guide the photosensitive film past air discharge ports of the end-fed air tubes 20, which discharge drying air toward the photosensitive film as illustrated by the arrows in FIG. 1, to a film output port 22. An air blower 24 is provided to supply heated air to a manifold of the film drying apparatus 16 to which the air tubes 20 are attached. Replenishment pumps 26 are provided to respectively pump high concentration replenishment developer and fixer solutions from a developer replenishment tank and fixer replenishment tank, not illustrated, to the developer tank 10 and fixer tank 12. Hot and cold water lines (not shown), with appropriate control values, are also provided to maintain a flow of water at the correct temperature to the wash tank 14. The operation of the processing system is controlled by a control unit 32, which includes instrumentation for monitoring the temperature of the solutions in the developer, fixer and wash tanks 10–14 and the temperature in the film drying apparatus 16.

Figure 2:
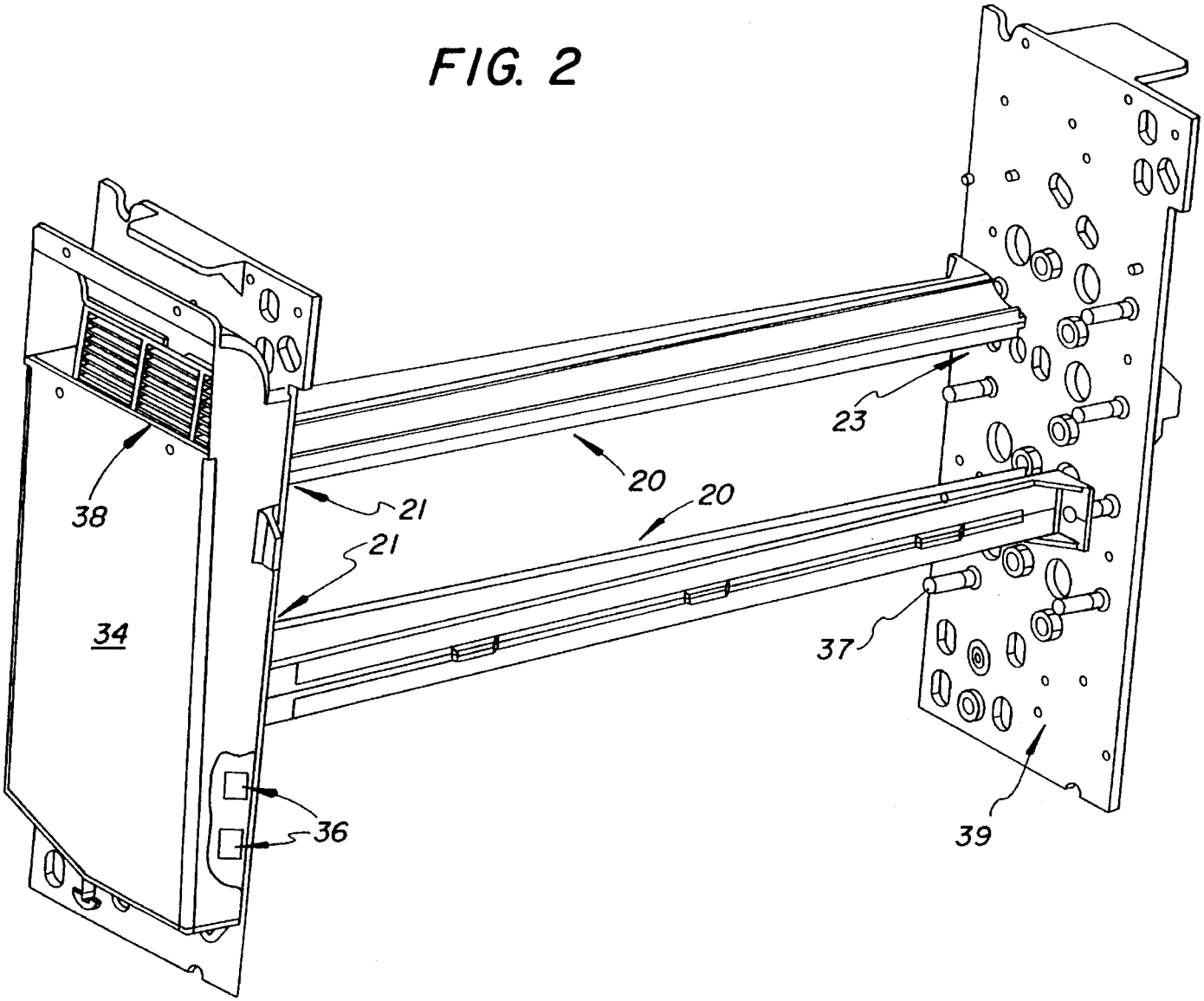
FIG. 2 illustrates a perspective view of the film drying apparatus with most of its guide rollers and air tubes removed.
Figure 3:
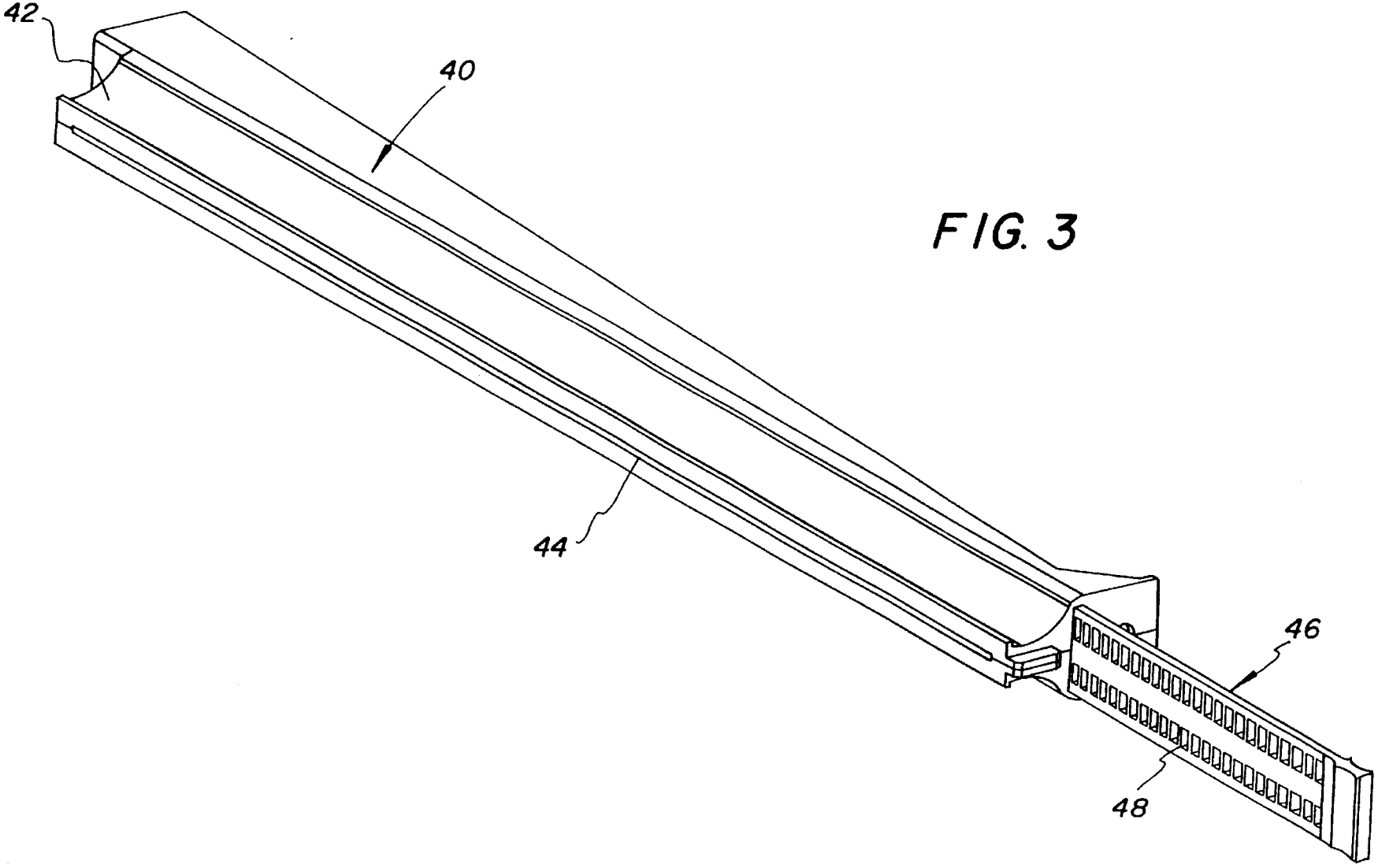
FIG. 3 is a perspective view of a single air tube of the kind utilized in the film drying apparatus illustrated in FIG. 2.
Figure 6:
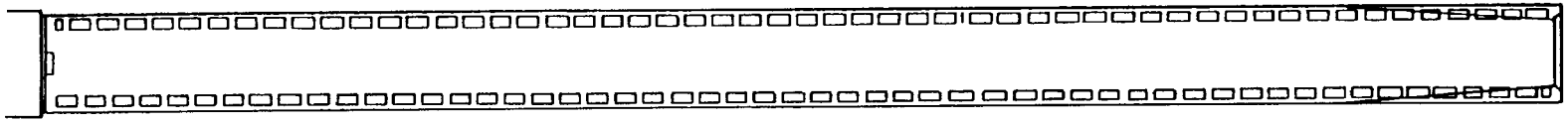
FIGS. 6–10 illustrate examples of different aperture geometries that can be utilized in the air diffuser illustrated in FIG. 3.
Figure 7:
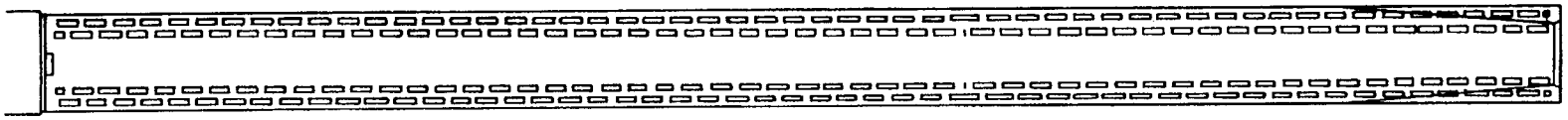
Figure 8:
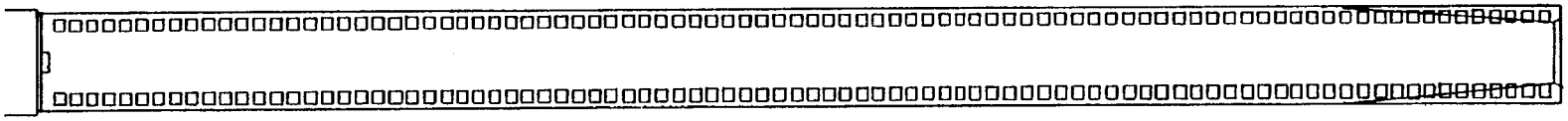
Figure 9:
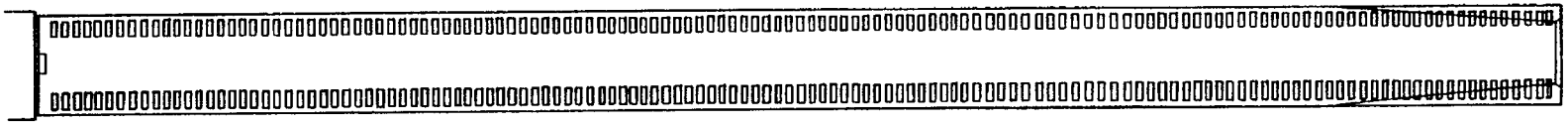
Figure 10:
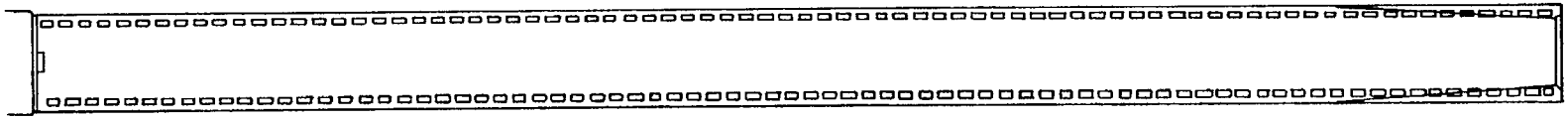

FIG. 2 illustrates a perspective view of the film drying apparatus 16 with most of the guide rollers 18 and air tubes 20 removed. Each of the air tubes 20 is attached at an air inlet end 21 thereof to a manifold output port 36 of an air manifold 34 that receives drying air from the blower 24 via a manifold air inlet 38, and at a closed end 23 opposite the air inlet end 21 to mounting posts 37 provided in a side mounting plate 39. As shown in greater detail in FIG. 3, the air tubes 20 include a main tube body 40 that is tapered along its length in a conventional manner, and an elongated air discharge port 42 having an air exhaust slot 44 that extends along its length. An internal air diffuser 46 is located between the main tube body 40 and the air discharge port 42. The internal air diffuser 46 can be inserted into a slot in the side of the air tube 20, and is illustrated in FIG. 3 as being partially inserted. The internal air diffuser 46 includes a plurality of air flow apertures 48 preferably formed as rectangles having dimensions of 0.90×0.25 inches as shown in FIG. 4. Other dimensions and geometries may be employed for the flow apertures 48, although it has been found that the length of the flow apertures 48 in the direction of air flow into the air tube should be no more than about three times the thickness of the air diffuser 46, as aspect ratios greater than 3:1 have been found to cause a degradation in performance. During operation, heated air from the air manifold 34 is supplied to the main tube body 40 at the air inlet end 21 of the air tube 20, passed from the main tube body 40 through the internal air diffuser 46 into the air discharge port 42 and uniformly discharged from the air exhaust slot 44 in a direction normal to a vertical plane defined by the length and width of the air exhaust slot 44.

FIG. 5 illustrates a cross-sectional view of the air tube 20 illustrated in FIG. 3. The air is essentially divided into a plurality of jet streams as it passes through the internal air diffuser 46. In order to recombine the jet streams as a continuous curtain of air that passes out of the air exhaust slot 44 of the air discharge port 42, the air flow apertures 48 are preferably offset from the air exhaust slot 44 such that the jet streams formed by the air flow apertures 46 strike preferably curved side walls 50 (angled flat surfaces may also be employed) of the air discharge port 42 and are recombined prior to exiting from the air exhaust slot 44. It is believed that, as long as the air flow apertures 48 are removed from the center line of the air exhaust slot 44 and are of sufficient area, the flow through each of the individual air flow apertures 48 can be viscous in form. The flow is therefore dominated by frictional losses instead of inertia, which aids in the recombination of the jet streams.

The results obtained from operation of the air tubes 20 depend on a number of variables including the geometry of the air tubes 20, the geometry of the air diffuser 46, and the distance of the air diffuser 46 from the air exhaust slot 44 of the air tube 20. In order to be considered acceptable, patterns from the air flow apertures 48 cannot appear on the film being dried or a simulated film surface (for example a liquid crystal sheet material exposed to a known thermal load), the air exiting the air exhaust slot 44 must be normal to the film plane (which is parallel to a plane defined by the air exhaust slot), the velocity pressure along the air exhaust slot 44 must be constant, restriction due to the air diffuser 46 must be negligible, and the results should be consistent through practical expected flow regimes (2–50 cfm). The combination of the tapered main tube body 40 and curved air discharge port 42 have been found to provide optimum performance, although other geometries may be readily employed. Specifically, no failures were observed at any flow rate until the value of the lateral distance from the air exhaust slot 44 to the air flow apertures 48 (X) was reduced to zero and the air flow aperture spacing exceeded 0.125 inches. Unacceptable results were observed, however, with a selected aspect ratio of 0.09×0.250 inches for the air flow apertures, when X=0 and the distance from the air exhaust slot 44 to the air diffuser 46 (Y) was reduced to 0.50 inches or less at low flow rates, and when the thickness of the air diffuser 46 was reduced to 0.025 or less. An analysis was also conducted to determine if the air tube performance would remain in the viscous (laminar) dominated regime through the practical air delivery range 2–50 cfm/tube. The analysis showed that the air tubes 20 will remain in laminar flow. As temperature increases the Reynolds number drops even further. Empirical testing also indicated that through the indicated flow range, the tube performance will improve as more mixing or turbulence occurs. Table 1 illustrates test results obtained at a temperature of 78 degrees Fahrenheit, a density of 0.001182198 grams/cc and viscosity of 0.000183797 poise, for an air tube 20 at the air inlet end 21, the air flow apertures and the air exhaust slot 44. Table 2 illustrates test results obtained at a temperature of 140 degrees Fahrenheit, a density of 0.001060187 grams/cc and viscosity of 0.000199914 poise.

TABLE 1

| | | | |
|---|---|---|---|
| | AIR INLET | | |
| Height | 1.000 in. | 1.000 in. | 1.000 in. |
| Width | 1.098 in. | 1.098 in. | 1.098 in. |
| Inlet Dia. | 1.047 in. | 1.047 in. | 1.047 in. |
| Total Area | 1.098 sq. in. | 1.098 sq. in. | 1.098 sq. in. |
| Flow | 5.0 cfm. | 10.0 cfm. | 50.0 cfm. |
| Flow cc/sec | 77 cc/sec | 155 cc/sec | 744 |
| Vbar cm/sec | 10.9 cm/sec | 21.9 cm/sec | 109.3 |
| Reynolds # | 187 | 374 | 1869 |
| | AIR FLOW APERTURE (235 Provided) | | |
| Height | 0.250 in. | 0.250 in. | 0.250 in. |
| Width | 0.090 in. | 0.090 in. | 0.090 in. |
| Inlet Dia. | 0.132 in. | 0.132 in. | 0.132 in. |
| Total Area (All Holes) | 5.288 sq. in. | 5.288 sq. in. | 5.288 sq. in. |
| Flow | 0.021 cfm. | 0.043 cfm. | 0.213 cfm. |
| Flow cc/sec | 0.33 cc/sec | 0.66 cc/sec | 3.29 |
| Vbar cm/sec | 2.3 cm/sec | 4.5 cm/sec | 22.7 |
| Reynolds # | 5 | 10 | 49 |
| | AIR EXHAUST SLOT | | |
| Height | 0.060 in. | 0.060 in. | 0.060 in. |
| Width | 18.00 in. | 18.00 in. | 18.00 in. |
| Inlet Dia. | 0.120 in. | 0.120 in. | 0.120 in. |
| Total Area (All Holes) | 1.080 sq. in. | 1.080 sq. in. | 1.080 sq. in. |
| Flow | 5.0 cfm. | 10.0 cfm. | 50.0 cfm. |
| Flow cc/sec | 77 cc/sec | 155 cc/sec | 774 |
| Vbar cm/sec | 11.1 cm/sec | 22.2 cm/sec | 111.1 |
| Reynolds # | 22 | 43 | 217 |

TABLE 2

| | | | |
|---|---|---|---|
| | AIR INLET | | |
| Height | 1.000 in. | 1.000 in. | 1.000 in. |
| Width | 1.098 in. | 1.098 in. | 1.098 in. |
| Inlet Dia. | 1.047 in. | 1.047 in. | 1.047 in. |
| Total Area | 1.098 sq. in. | 1.098 sq. in. | 1.098 sq. in. |
| Flow | 5.0 cfm. | 10.0 cfm. | 50.0 cfm. |
| Flow | 77 cc/sec | 155 cc/sec | 744 |

TABLE 2-continued

| | | | |
|---|---|---|---|
| cc/sec | | | |
| Vbar cm/sec | 10.9 cm/sec | 21.9 cm/sec | 109.3 |
| Reynolds # | 154 | 308 | 1541 |
| | AIR FLOW APERTURE (235 Provided) | | |
| Height | 0.250 in. | 0.250 in. | 0.250 in. |
| Width | 0.090 in. | 0.090 in. | 0.090 in. |
| Inlet Dia. | 0.132 in. | 0.132 in. | 0.132 in. |
| Total Area (All Holes) | 5.288 sq. in. | 5.288 sq. in. | 5.288 sq. in. |
| Flow | 0.021 cfm. | 0.043 cfm. | 0.213 cfm. |
| Flow cc/sec | 0.33 cc/sec | 0.66 cc/sec | 3.29 |
| Vbar cm/sec | 2.3 cm/sec | 4.5 cm/sec | 22.7 |
| Reynolds # | 4 | 8 | 40 |
| | AIR EXHAUST SLOT | | |
| Height | 0.060 in. | 0.060 in. | 0.060 in. |
| Width | 18.00 in. | 18.00 in. | 18.00 in. |
| Inlet Dia. | 0.120 in. | 0.120 in. | 0.120 in. |
| Total Area (All Holes) | 1.080 sq. in. | 1.080 sq. in. | 1.080 sq. in. |
| Flow | 5.0 cfm. | 10.0 cfm. | 50.0 cfm. |
| Flow cc/sec | 77 cc/sec | 155 cc/sec | 774 |
| Vbar cm/sec | 11.1 cm/sec | 22.2 cm/sec | 111.1 |
| Reynolds # | 18 | 36 | 179 |

The invention has been described with reference to certain preferred embodiments thereof. It will be understood, however, that modifications and variations are possible within the scope of the appended claims. The shape and size of the apertures, for example, may be readily varied. FIGS. 6–10, for example, illustrate air diffusers having various configurations that have been found to be acceptable for air tubes having an air inlet of 1.503 square inches and an air discharge port having dimensions of 0.06×18 inches. The dimensions of the air flow apertures illustrated in FIGS. 6–10 are respectively (in inches) 0.25×0.125, 0.25×0.062, 0.125×0.125, 0.06×0.150 and 0.150×0.06. Non-rectangular openings, however, may also be employed. In addition, an array of blades, similar to the stator blades in a turbine or a venetian blind, may also be utilized for the air diffuser instead of a single plate with aperture holes.

Figure 11:
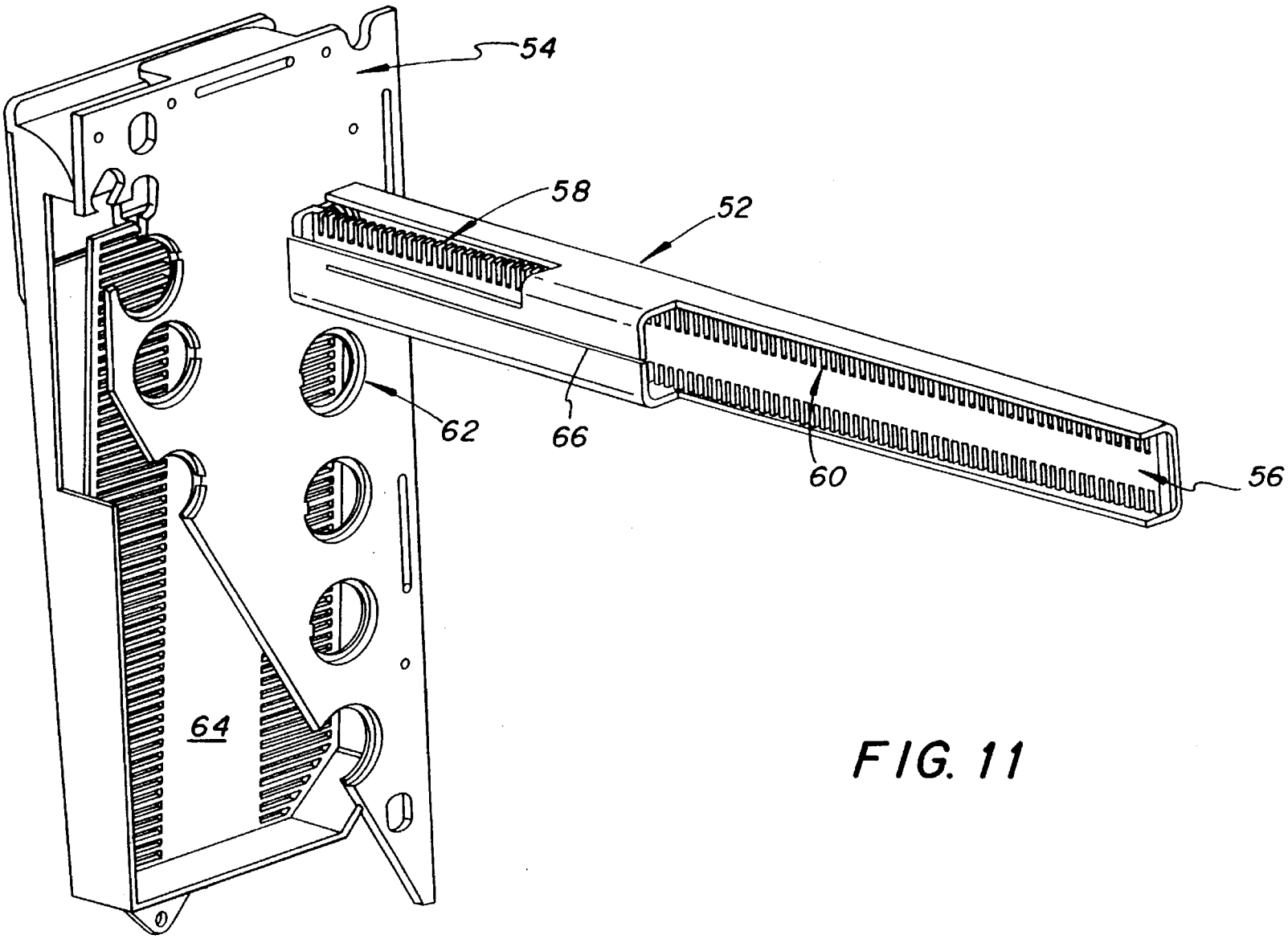
FIG. 11 illustrates a further embodiment with a square air tube.

In addition, the shape of the air tube may be readily varied. FIG. 11, for example, illustrates the attachment of a substantially square air tube 52 to an air manifold 54. In this embodiment, an air diffuser 56 is located at an angle within the square air tube 52. The upper and lower edges of the air diffuser 56 are formed as a comb-like structure with a plurality of projections 58, although air diffusers of the types discussed above may also be employed. As the air diffuser 56 is placed in the air tube 52, the projections 58 contact that upper and lower surfaces of the air tube 52, thereby forming rectangular air flow apertures 60. Air passing from an air manifold output port 62 and into the air tube 52 strikes the airflow apertures 60 and is diverted 90 degrees. The air therefore exits the air flow apertures 60 in a direction perpendicular to the direction of air flow into the air tube 52.

As also illustrated in FIG. 11, a manifold air diffuser 64 is also preferably provided within the air manifold 54. The manifold air diffuser 64 is angled such that it is closest to the manifold outlet ports 62 at the end of the air manifold 54 that receives the air, and is farthest from the manifold outlet ports 62 at the opposite end of the air manifold 54. The provision of manifold air diffuser 64 insures uniform air flow through each of the manifold outlet ports 56.

Industrial Utility

The invention is particularly useful in providing a uniform flow of drying air in a photosensitive film drying apparatus. The invention is not limited to this particular application, however, and can be incorporated into other devices that are utilized to dry other materials including non-photosensitive webs or film.

| Reference Numerals | |
|---|---|
| 6 | Film Input Port |
| 8 | Film Transport Mechanism |
| 10 | Developer Tank |
| 12 | Fixer Tank |
| 14 | Wash Tank |
| 16 | Film Drying Apparatus |
| 18 | Guide Rollers |
| 20 | Air Tubes |
| 21 | Air Inlet End |
| 22 | Film Output Port |
| 23 | Closed End |
| 24 | Air Blower |
| 26 | Replenishment Pumps |
| 32 | Control Unit |
| 34 | Air Manifold |
| 36 | Manifold Output Ports |
| 37 | Mounting Posts |
| 38 | Manifold Air Inlet |
| 39 | Side Mounting Plate |
| 40 | Main Tube Body |
| 42 | Air Discharge Port |
| 44 | Air Exhaust Slot |
| 46 | Air Diffuser |
| 48 | Air Flow Apertures |
| 50 | Side Walls |
| 52 | Air Tube |
| 54 | Air Manifold |
| 56 | Air Diffuser |
| 58 | Projections |
| 60 | Air Flow Apertures |
| 62 | Manifold Output Port |
| 64 | Manifold Air Diffuser |
| 66 | Air Exhaust Slot |

What is claimed is:

1. An air tube comprising:

an elongate main tube body including an open air inlet end and a closed end opposite said open air inlet end;

an air discharge port adjoining to said main tube body between said ends, said air discharge port including an air exhaust slot; and an air diffuser disposed between said main tube body and said air discharge port, said air diffuser having a plurality of air flow apertures, substantially all said apertures being disposed at a lateral offset from said air exhaust slot.

2. An air tube as claimed in claim 1, wherein said air flow apertures have a length, in a direction substantially parallel to the longest dimension of said main air body, that is not more than three times the thickness of said air diffuser.

3. An air tube as claimed in claim 1, wherein said air diffuser is disposed such that said air diffuser is closest to said air exhaust slot at said open air inlet end and farthest from said air exhaust slot at said closed end.

4. An air tube as claimed in claim 1, wherein said air discharge port has a pair of inwardly curved side walls extending between said air exhaust slot and said main tube body.

5. An air tube as claimed in claim 1, wherein said air diffuser has a thickness of less than or equal to 6.35 mm (0.25 inches).

6. An air tube as claimed in claim 1, wherein said air flow apertures have a spacing of not greater than 3.175 mm (0.125 inches).

7. An air tube as claimed in claim 1, wherein said air flow apertures are substantially rectangular.

8. An air tube as claimed in claim 1, wherein said main tube body is tapered.

9. An air tube comprising:

a tapered, elongate main tube body including an open air inlet end and a closed end opposite said open air inlet end;

an elongate air discharge port joined to said main tube body, said air discharge port including an air exhaust slot disposed substantially parallel to the longest dimension of said main tube body; and an air diffuser disposed between said main tube body and said air discharge port, said air diffuser having a plurality of air flow apertures, said apertures being disposed at an offset from said air exhaust slot, said air flow apertures each having a length, in a direction substantially parallel to the longest dimension of said main tube body, that is not more than three times the thickness of said air diffuser.

10. An air tube as claimed in claim 9, wherein said air diffuser is disposed such that said air diffuser is closest to said air exhaust slot at said open air inlet end and farthest from said air exhaust slot at said closed end.

11. An air tube as claimed in claim 10, wherein said air discharge port has a pair of inwardly curved side walls extending between said air exhaust slot and said main tube body.

12. An air tube comprising:

an elongate main tube body including an open air inlet end and a closed end opposite said open air inlet end;

an air discharge port adjoining to said main tube body between said ends, said air discharge port including an air exhaust slot; and an air diffuser disposed between said main tube body and said air discharge port, said air diffuser having a plurality of air flow apertures, said apertures being disposed at an offset from said air exhaust slot, said air flow apertures having a length, in a direction substantially parallel to the longest dimension of said main air body, that is not more than three times the thickness of said air diffuser.

13. An air tube as claimed in claim 12, wherein said air flow apertures have a width of 0.223 mm (0.090 inches) and a length of 6.35 mm (0.250 inches).

14. An air tube comprising:

an elongate main tube body including an open air inlet end and a closed end opposite said open air inlet end;

an air discharge port adjoining to said main tube body between said ends, said air discharge port including an air exhaust slot; and an air diffuser disposed between said main tube body and said air discharge port, said air diffuser having a plurality of air flow apertures, said apertures being disposed at an offset from said air exhaust slot, said air diffuser having a thickness of less than or equal to 6.35 mm (0.25 inches).

15. An air tube comprising:

an elongate main tube body including an open air inlet end and a closed end opposite said open air inlet end;

an air discharge port adjoining to said main tube body between said ends, said air discharge port including an air exhaust slot; and an air diffuser disposed between said main tube body and said air discharge port, said air diffuser having a plurality of air flow apertures, said apertures being disposed at an offset from said air exhaust slot, said air flow apertures having a spacing of not greater than 3.175 mm (0.125 inches).

* * * * *